US005950560A

United States Patent [19]

Block et al.

[11] Patent Number: 5,950,560

[45] Date of Patent: Sep. 14, 1999

[54] METHOD AND DEVICE FOR IMPROVING READING COMFORT

[76] Inventors: Mary A. Block, 3716 Lands End St., Fort Worth, Tex. 76109-3231; Joan F. Anderson, 4619 Ranch View Rd., Fort Worth, Tex. 76109

[21] Appl. No.: 09/065,394

[22] Filed: Apr. 23, 1998

Related U.S. Application Data

[60] Provisional application No. 60/046,517, May 15, 1997.

[51] Int. Cl.[6] ..... B42D 9/00

[52] U.S. Cl. ..... 116/240; 116/201

[58] Field of Search ..... 116/234, 235, 116/240, 304, DIG. 41

[56] References Cited

U.S. PATENT DOCUMENTS 3,140,883 7/1964 Anthony .
3,324,823 6/1967 Peters ..... 116/234
3,409,347 11/1968 Vogel .
3,739,739 6/1973 Brase .
4,457,585 7/1984 DuCorday ..... 350/235

FOREIGN PATENT DOCUMENTS 2510723 9/1976 Germany .

*Primary Examiner*—Hezron Williams
*Assistant Examiner*—Willie Morris Worth
*Attorney, Agent, or Firm*—Carla J. Dolce

[57] ABSTRACT

A kit is disclosed for improving reading comfort or increasing interest in reading, the kit comprising at least two differently-colored transparent overlays. Also disclosed is a method for improving reading comfort or increasing interest in reading comprising the steps of sequentially placing each of at least two differently-colored overlays over the material being read, subjectively determining which of the differently-colored overlays provides the maximum eye comfort while reading or creates the greatest interest in reading, and placing the overlay that provides maximum eye comfort or interest over the material being read.

10 Claims, 2 Drawing Sheets

METHOD AND DEVICE FOR IMPROVING READING COMFORT

RELATED APPLICATION

This application is entitled to the benefit of the filing date of the earlier filed provisional application Ser. No. 60/046,517, filed May 15, 1997.

BACKGROUND OF THE INVENTION

1. Field of the Invention

This invention relates to a method and apparatus for improving reading comfort and increasing interest in reading by use of colored transparent overlays.

2. Description of Related Art

Many methods of teaching reading are known, such as the phonics system. However, there are few products and little information available on ways to enhance the reading ability of a person who already reads, or ways to encourage children to continue to read outside the classroom. One existing system is that described in U.S. Pat. No. 4,961,640, issued Oct. 9, 1990, to H. L. Irlen. This system (the "Irlen System") is used for children and adults who suffer from a functional disorder referred to as the "Irlen Syndrome of scotopic sensitivity." In the Irlen System, the patient is tested to identify one specific color and color density that ameliorates the patient's symptoms. The patient is then fitted with glasses having lenses of the prescribed color and color density.

The Irlen System is specifically for persons suffering from scotopic sensitivity. Additionally, the Irlen System is relatively expensive in that it requires testing by a trained professional and manufacture of specially designed lenses for each individual. There is a need for a device and/or method to improve reading comfort for all persons whether or not they suffer from any diagnosed disorder. Additionally, there is a need for a device and/or method to increase interest in reading, particularly in children.

SUMMARY OF THE INVENTION

It is an object of the present invention to provide a simple and inexpensive device and method for improving reading comfort in all persons.

It is a further object of the present invention to provide a simple and inexpensive device and method for increasing interest in reading, particularly in children.

Accordingly, the present invention provides an inexpensive device and method for enhancing reading comfort for all readers, whether or not they suffer from scotopic sensitivity or any other disorder.

The present invention comprises a kit of at least two differently-colored transparent bookmarks that are essentially transparent colored overlays. These overlays are laid over the text to be read and may be moved about over the page at the desire of the reader. Because the overlays are transparent, they may be combined to create additional colors.

The invention also provides a method for improving reading comfort or increasing interest in reading comprising the steps of sequentially placing each of at least two differently-colored overlays over the material being read, subjectively determining which of the differently-colored overlays provides the maximum eye comfort while reading or creates the greatest interest in reading, and placing the overlay that provides maximum eye comfort or interest over the material being read.

The device and method of the present invention encourage the reader to experiment with different colors for individual mood, comfort, and lighting, instead of restricting the reader's options or requiring colored glasses, as in the Irlen System. Readers benefit from the calming effect of using the best overlay, selected from the kit of differently colored overlays, and feel more comfortable. The colored overlays increase interest in reading in children who also benefit from the increased reading practice they undertake when using the overlays.

In addition to improving reading comfort, the overlays assist readers because they can be used to track text and pace reading by highlighting the text being read. Finally, the overlays may also be used as bookmarks in the traditional sense, but in the present invention they serve the primary purpose of improving reading comfort and ability.

DRAWINGS

DETAILED DESCRIPTION

Figure 1:
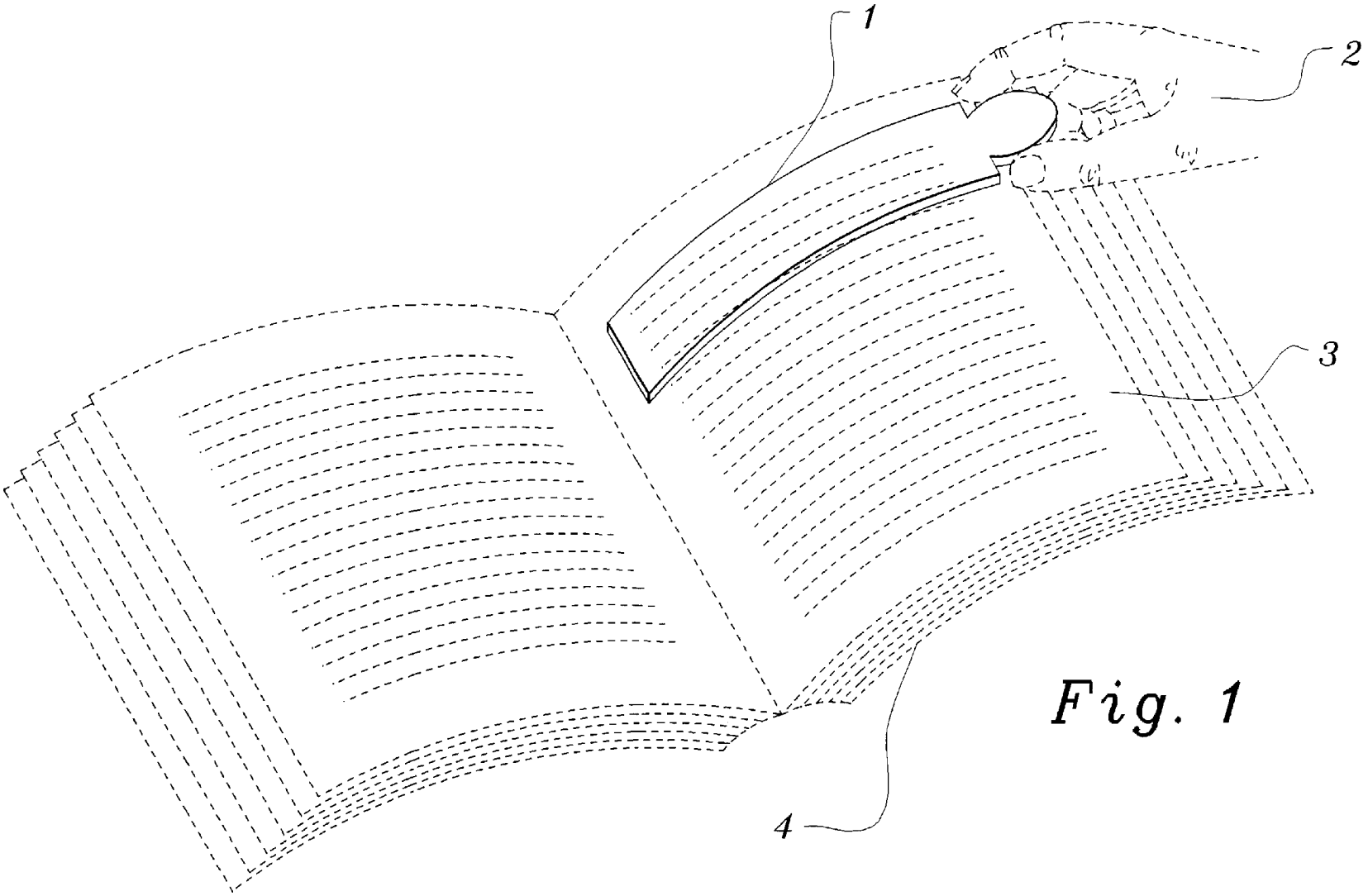
FIG. 1 shows a typical overlay of the invention.

The invention provides a kit for improving reading comfort or increasing interest in reading comprising at least two differently-colored transparent overlays. The typical overlay 1 shown in FIG. 1 is a flat slab of plastic material. The preferred plastic is PVC (poly-vinyl chloride), but other resilient and transparent plastics could be used. The overlay 1 has a thickness chosen to allow it some flexibility while being sturdy enough to withstand frequent handling. In the preferred embodiment, this thickness is between approximately 0.381 mm (0.015 inch) and 1.524 mm (0.06 inch) or, preferably, approximately 0.51 mm (0.02 inch).

Each side of the overlay 1 is polished or finished smoothly, so as not to disperse light passing through the overlay 1, or to cause distortion. The overlay 1 is made of transparent and colored plastic. The overlay 1 should allow text to be seen through it with minimal blurring or distortion. The only effect created by the overlay 1 is color.

The overlay 1 is dimensioned so as to extend to at least the entire length of the lines of a typical book 4 or a column of print in a magazine or newspaper. Its orthogonal dimension is sized so as to cover at least 3 or 4 lines of text. In the preferred embodiment, the dimensions are 15.875 cm (6.25 inches) by 7.62 cm (3.0 inches). Another embodiment of the invention, shown in FIG. 3, has a handle attached to one side of the overlay 1 along its long axis.

Figure 3:
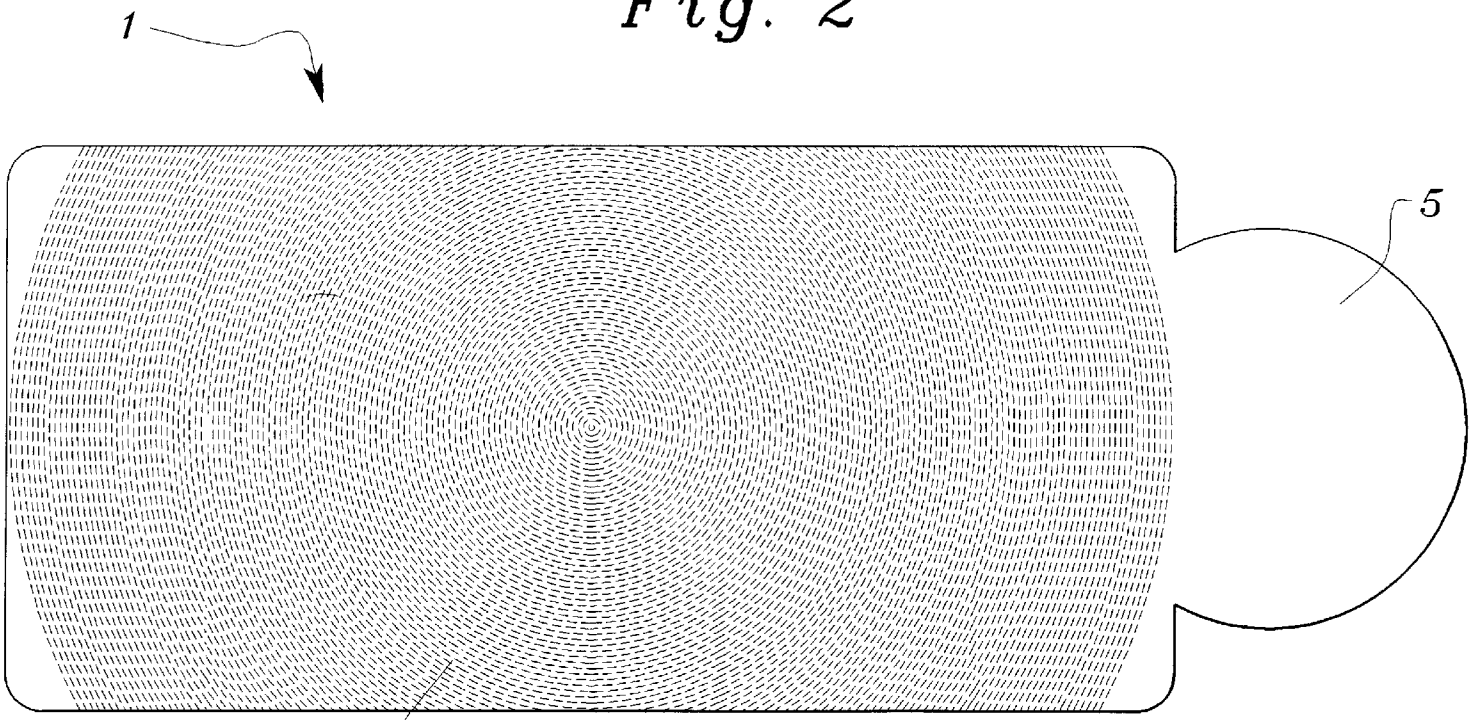
FIG. 3 shows a overlay having a handle.

In another embodiment of the invention, the overlay 1 is refractive, so that text lying under it is magnified. The overlay 1 may be made refractive by molding or shaping a curvature in at least one surface thereof, or by molding or engraving a Fresnel lens 6 in at least one surface, as shown in FIG. 3.

Each kit comprises at least two differently-colored overlays 1. In the preferred embodiment of the invention, five or six differently-colored overlays 1 are used for each kit. The colors may be pink, orange, yellow, blue, violet, and green, sky blue or any other color. In general, the greater number and variety of colors used for the overlays 1, the more the interest of the reader will be aroused and the greater the opportunity the reader has to find a color that maximizes reading comfort. However, the number must also be limited for reasons of cost and convenience in handling. In the preferred embodiment, the optimal number is five or six differently-colored overlays. Since the overlays 1 are transparent, two or more may be combined, to produce a different color, according to the additive color system. For example, yellow and blue overlays 1 laid one over the other would produce a green color.

The invention also provides a method for improving reading comfort or increasing interest in reading comprising the steps of sequentially placing each of at least two differently-colored overlays 1 over the material being read, subjectively determining which of the differently-colored overlays I provides the maximum eye comfort while reading or creates the greatest interest in reading, and placing the overlay 1 that provides maximum eye comfort or interest over the material being read.

Figure 2:
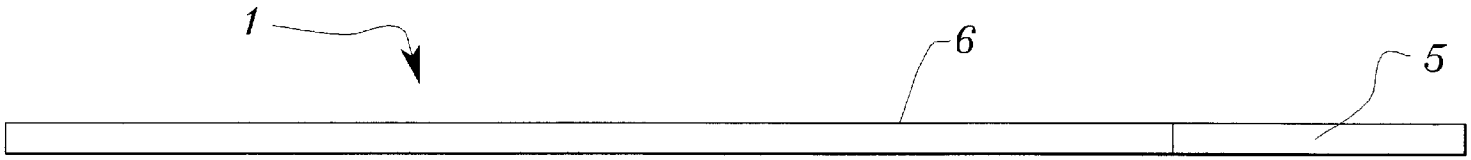
FIG. 2 shows a typical overlay placed over the text of a book.

Essentially, the kit of overlays 1 is provided to the reader, and the reader is instructed to choose a color. FIG. 2 shows a typical book 4 where an overlay 1 is placed by the reader 2 over a page 3 of text. If the overlay 1 is smaller than the entire page of text as depicted in the Figures, the reader 2 moves the overlay 1 up and down the page 3 at his or her desire. The overlay 1 also assists readers in tracking text or in pacing their reading as they move it up and down a page 3 of text.

The reader may, at any time, choose a different overlay 1 from the kit and use this overlay 1 as desired. As described above, the reader 2 can choose differently-colored overlays 1, and she or he can also combine the overlays to produce additional colors. It is important that the reader 2 have a choice of differently-colored overlays 1 so as to maintain interest through variety and increase the opportunity for the reader to find a color that maximizes reading comfort. The overlays 1 of the method are the same as described for the device of the invention.

It has been found that the use of the overlays 1 by readers, especially children, enhances both reading comfort and interest in reading. An enhancement in reading ability may also come about through practice, because the use of the overlays 1 enhances the desire to practice reading. Children who suffer from attention deficit hyperactivity disorder, and learning and reading difficulties, typically benefit from both reading practice and a calming effect produced by use of the colored overlays 1. The overlays 1 also reduce glare from a white page 3. The experience is analogous to that felt by persons using sunglasses in conditions of glare.

Although the present invention has been shown and described with respect to preferred embodiments, various changes and modifications which are obvious to a person skilled in the art to which the invention pertains are deemed to lie within the spirit and scope of the invention.

We claim:

1. A method for improving reading comfort or increasing interest in reading comprising the following steps:

sequentially placing each of between two and six differently-colored overlays over the material being read;

subjectively determining which of the differently-colored overlays provides the maximum eye comfort while reading or creates the greatest interest in reading;

placing the overlay that provides maximum eye comfort or interest over the material being read; and repeating, at the readers discretion to ensure continued reader comfort, the steps of sequentially placing each of between two and six differently-colored overlays over the material being read; subjectively determining which of the differently-colored overlays provides the maximum eye comfort while reading or creates the greatest interest in reading; and placing the overlay that provides maximum eye comfort or interest over the material being read.

2. The method of claim 1 further comprising the step of combining two of the overlays to produce an additional differently-colored overlay.

3. The method of claim 1 further comprising the step of moving the overlay up and down the page to cover the text being read so as to assist the reader in tracking the text being read.

4. The method of claim 1 wherein the differently colored overlays are dimensioned so to as to extend to at least the entire length of the lines of a typical book and to cover at least four lines of text.

5. The method of claim 1 wherein the dimensions of each overlay are approximately 15.875 cm (6.25 inches) by 7.62 cm (3.0 inches).

6. The method of claim 1 wherein the overlays are polished so as not to disperse light and cause distortion.

7. The method of claim 1 wherein at least one of the overlays has a refractive surface for magnifying the material being read.

8. The method of claim 1 wherein the overlays are between 0.381 mm (0.015 inch) and 1.524 mm (0.06 inch) in thickness.

9. The method of claim 1 wherein the number of differently-colored transparent overlays is five.

10. The method of claim 1 wherein the overlays each have a handle.

* * * * *